United States Patent [19]

Kellogg et al.

[11] 4,413,447

[45] Nov. 8, 1983

[54] GROOVE REFINISHING TOOL

[75] Inventors: Harvey J. Kellogg, Homossassa, Fla.; Robert O. Holm, Santa Fe, N. Mex..

[73] Assignee: The United States of America as represented by the U.S. Department of Energy, Washington, D.C.

[21] Appl. No.: 242,806

[22] Filed: Mar. 11, 1981

[51] Int. Cl.[3] ..... B24B 23/00

[52] U.S. Cl. ..... 51/170 PT; 51/170 R

[58] Field of Search ..... 51/170 R, 170 PT, 170 T

[56] References Cited

U.S. PATENT DOCUMENTS

| | | | |
|---|---|---|---|
| 1,872,502 | 8/1932 | Reid | 51/170 PT |
| 2,810,240 | 10/1957 | Davis et al. | 51/170 PT |
| 3,164,932 | 1/1965 | Morith | 51/170 PT |
| 3,984,946 | 10/1976 | Waters | 51/170 PT |

*Primary Examiner*—E. R. Kazenske
*Assistant Examiner*—Willmon Fridie, Jr.
*Attorney, Agent, or Firm*—Paul D. Gaetjens; Robert W. Weig; Richard G. Besha

[57] ABSTRACT

A groove refinishing tool which utilizes a finishing wheel which is controlled by an air grinder motor. The air grinder motor is mounted on a main body section which is pivotally attached to a shoe element. The shoe element contains guide pins which guide the shoe element on the groove to be refinished. Application of pressure on the main body element compresses a weight counterbalance spring to extend the finishing wheel through the shoe element to refinish the groove surface. A window is provided for viewing the refinishing operation. Milling operations can also be performed by replacing the finishing wheel with a milling wheel.

7 Claims, 3 Drawing Figures

MAIN BODY HINGE HOLE 32
56
HAND HOLD 14
10 MAIN BODY
MAIN BODY FINISHING WHEEL SLOT 12
18 WINDOW
AIR GRINDER MOTOR MOUNT 20
22 ACCESS HOLE
48
HAND HOLD 16
DEPTH STOP ADJUSTMENT SCREW 24
SPRING ADJUSTMENT 26
LOCK NUT 30
28 WEIGHT COUNTERBALANCE SPRING

ARBOR 42
46
44 FINISHING WHEEL
40 COLLET
VALVE CONTROL 38
34 AIR GRINDER MOTOR
36 AIR INLET

GROOVE REFINISHING TOOL

This invention is the result of a contract with the Department of Energy (Contract No. W-7405-ENG-36).

BACKGROUND OF THE INVENTION

In many scientific applications as well as industrial applications it is necessary to use o-rings to provide a hermetical seal between two adjoining metal surfaces. The o-rings, are normally disposed in o-ring grooves on each of the adjoining metal surfaces to provide proper compression and disposition of the o-ring seal. Contact of the o-ring seal on the surface of the o-ring groove provides the hermetical seal. In many instances, however, the inner surface of the o-ring groove is not sufficiently smooth to provide the desired hermetical seal between the o-ring seal and the groove surface. This can occur from damage to the o-ring groove or improper machining techniques. Improper machining techniques are especially prevalent in large vacuum tanks where milling machines are allowed to chatter during the milling process leaving chatter marks on the bottom surface of the o-ring groove. It is therefore necessary, in many instances, to refinish the bottom surface of the o-ring groove so that a proper hermetical seal can be formed between the o-ring and the o-ring groove. In most cases, the only manner of obtaining a properly finished o-ring groove is to ship the device back to the manufacturer for refinishing in accordance with specifications. This not only causes time delays, but also can be extremely expensive for large items such as large vacuum tanks.

Consequently, it would be desirable to be able to refinish o-ring grooves on location with a device which is portable, hand held and capable of providing a properly refinished groove surface which provides a hermetical seal.

SUMMARY OF THE INVENTION

It is therefore an object of the present invention to provide a groove refinishing device.

It is also an object of the present invention to provide a device for refinishing grooves which is portable.

Another object of the present invention is to provide a device for refinishing grooves which is hand held.

Another object of the present invention is to provide a device for refinishing grooves which is simple and efficient in operation.

Another object of the present invention is to provide a device for refinishing grooves on location.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purpose of the present invention, as embodied and broadly described herein, the apparatus of this invention may comprise a device for refinishing grooves comprising: a main body having a main body finishing wheel slot formed therein; a shoe having a shoe finishing wheel slot formed therein, said shoe pivotally mounted to said main body; a finishing wheel motor attached to said main body; a finishing wheel attached to said finishing wheel motor such that said finishing wheel protrudes through said main body finishing wheel slot and said shoe finishing wheel slot; slot guide means attached to said shoe for guiding said device on said grooves as said device is refinishing said grooves.

The advantages of the present invention are that it is capable of providing a refinished groove surface for a large tank or other hermetically sealed device on location using a portable, hand held tool. The device is capable of providing a refinished surface on any desired groove in a quick and efficient manner. Additionally, the device can be operated by one person on o-ring grooves having a variety of diameters by adjusting the position of the finishing wheel with respect to the slot guides. Also, the finishing wheel can be quickly replaced without altering the position of the replacement finishing wheel with respect to the slot guides, thereby insuring a uniform refinishing operation.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE PREFERRED EMBODIMENT OF THE INVENTION

Figures 1, 2:
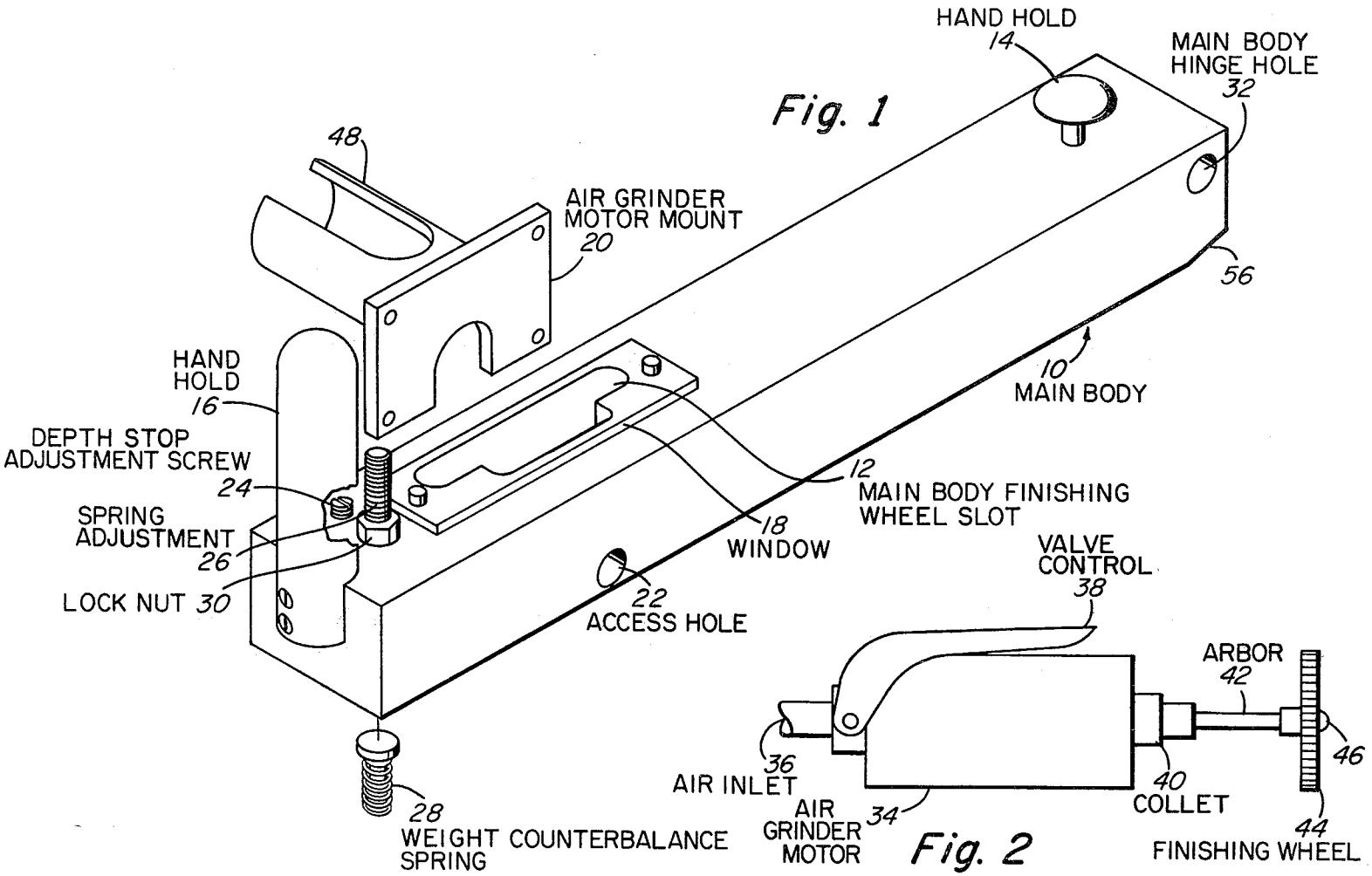
FIG. 1 is a perspective view assembly drawing of the main body of the device of the present invention.
FIG. 2 is a side view of the air grinder motor of the present invention.

FIG. 1 is a perspective assembly view of the main body 10 of the preferred embodiment of the invention. The main body 10 comprises a rectangularly shaped piece of metal having a main body finishing wheel slot 12 formed therein. The main body finishing wheel slot 12 is sufficiently large to allow for insertion of a desired finishing wheel. Hand holds 14 and 16 are attached to the upper surface of the main body 10. Window 18 is also attached to the upper surface of the main body 10 over the main body finishing wheel slot 12 to provide visual observation of the device during operation. An air grinder motor mount 20 is attached to one side of the main body 10 directly adjacent and centered with the main body finishing wheel slot 12. The air grinder motor mount 20 is positioned closer to the lower surface of main body 10 so that the finishing wheel will protrude from the lower surface of the main body 10. An access hole 22 is also provided in the main body 10 to insert a screwdriver or other tool for removing the finishing wheel from the air grinder motor. A depth stop adjustment screw 24 is threaded through the main body 10 from the top surface to provide an adjustable separation between the main body 10 and the shoe illustrated in FIG. 3. A spring adjustment screw 26 is also threaded through the main body and provides adjustment of weight counterbalance spring 28 which is slipfit into a hole from the lower surface of the main body 10. Locknut 30 secures the spring adjustment screw 26. Main body hinge hole 32 provides the pivotal attachment between the shoe illustrated in FIG. 3 and the main body 10 illustrated in FIG. 1.

FIG. 2 is a side view of the air grinder motor 34. The air grinder motor can comprise a standard 1400 rpm air driven motor using pressurized air from air inlet 36. Valve control 38 controls the operation of the air grinder motor 34. Collet 40 provides an adjustable means of securing arbor 42. Arbor 42 is threaded on one end for attachment of a finishing wheel 44 by way of screw 46. Finishing wheel 44 can comprise, e.g., a $\frac{1}{4}$ inch wide by $2\frac{1}{2}$ inch diameter abrasive flap wheel such as the flap wheel marketed by Merit Abrasive Products Incorporated, Compton, California and more fully illustrated in U.S. Pat. Nos. 3,468,642, 3,561,173 and 3,795,498.

Air grinder motor 34 is mounted in the air grinder motor mount 20 illustrated in FIG. 1 by removing the finishing wheel 44 and reattaching the finishing wheel 44 using access the hole 22 illustrated in FIG. 1. Slot 48 of air grinder motor mount 20 provides movement for valve control 38. Although, as illustrated, air grinder motor 34 can be detached from the air grinder motor mount 20, air grinder motor mount 34 can be integrally attached to the air grinder motor mount 20 rather than using it as a removable unit. In such a situation, however, provision must be made for access to the collet 40 for adjustment and removal of arbor 42. Additionally, any suitable motor including electric motors, etc., can be utilized rather than an air grinder motor such as illustrated in FIG. 2.

Figure 3:
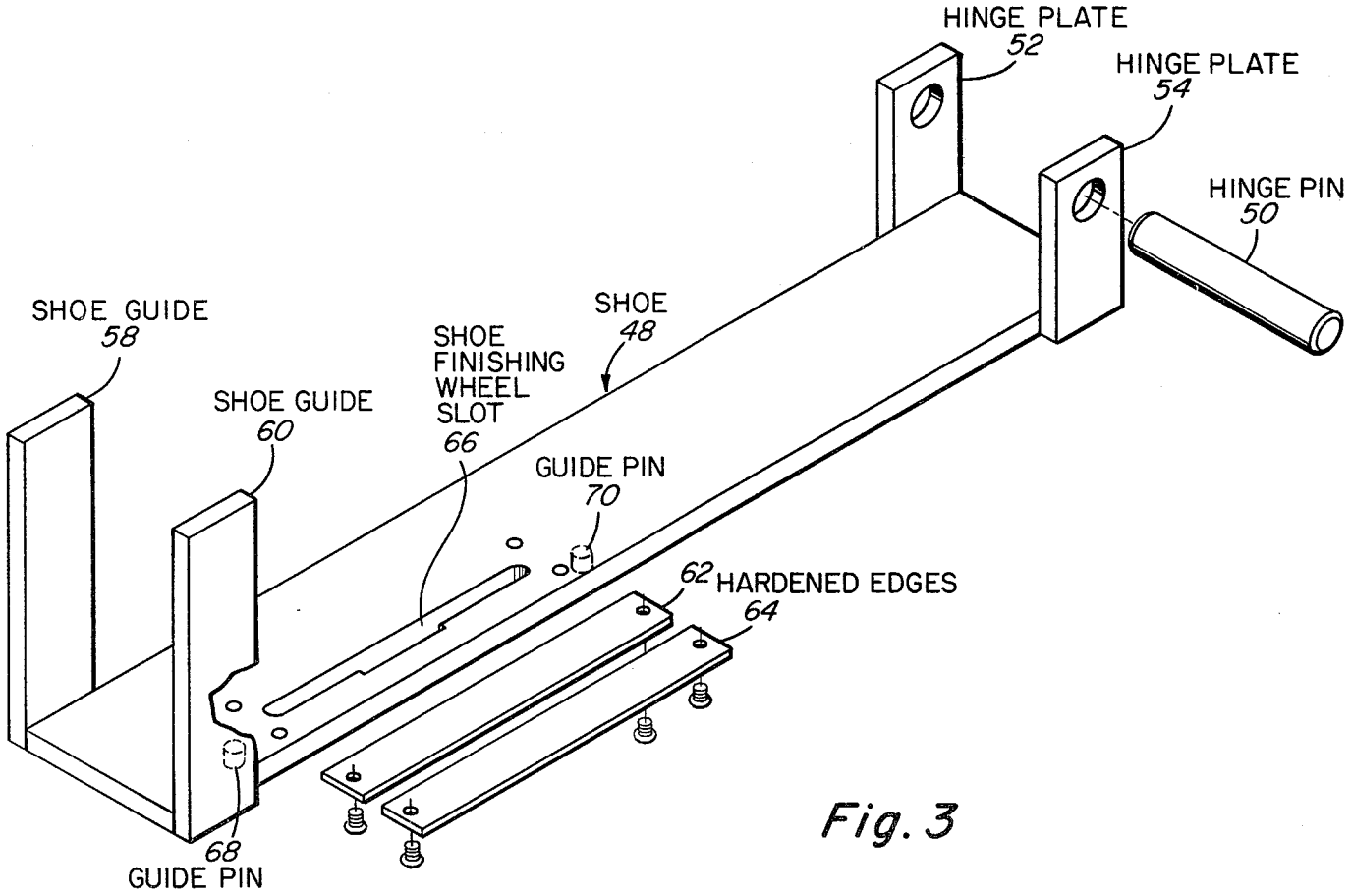
FIG. 3 is a perspective view assembly drawing of the shoe element of the present invention.

FIG. 3 illustrates the shoe element of the device of the preferred embodiment of the invention. The shoe element is pivotally attached to the main body 10 by hinge pin 50 which is inserted through hinge plate 52, main body hinge hole 32 and hinge plate 54, such that the main body 10 rests on top of the shoe element 48. The main body 10 is fabricated with a contour 56 to provide clearance between the main body 10 and shoe 48 when pivoting on hinge pin 50. Shoe guides 58 and 60 surround the side of main body 10 and guide the pivotal action between the main body 10 and shoe element 48 so as to restrict side motion between these elements. Hardened edges 62 and 64 are attached to the lower surface of shoe 48 so that the side motion of the finishing wheel 44 is controlled and does not exceed the limits set by the hardened edges 62 and 64. Shoe finishing wheel slot 66 provides an access hole for the finishing wheel 44 when the main body is compressed on weight counterbalance spring 28. Weight counterbalance spring 28 rests on the upper surface of shoe 48. Guide pins 68 and 70 protrude from the lower surface of the shoe element 48 and rests in the groove to be refinished. The pins are made of a size which is calculated to allow sufficient side motion so that the entire lower groove surface of the groove can be polished by exerting hand pressure to one side or the other. Additionally, the guide pins 68 and 70 can be threaded into shoe 48 to allow for interchangeability to fit different size grooves. Additionally, guide pins 68 and 70 are offset by a predetermined amount to account for curvature in an o-ring groove. Shoe finishing wheel slot 66 and main body finishing wheel slot 12 can also be made sufficiently wide to allow for adjustment of arbor 42 to fit various diameter o-ring grooves and straight grooves.

In operation, the air grinder motor 34 is placed in the air grinder motor mount 20 and finishing wheel 44 is attached to arbor 42 using access hole 22. The proper depth adjustment is then set on depth stop adjustment screw 24 and spring pressure is adjusted using spring adjustment 26 and locknut 30. The device is then placed on the o-ring groove using guide pins 68 and 70. Arbor 42 is then adjusted for the proper setting using collet 40 so that the finishing wheel 44 is aligned to finish the desired portion of the o-ring groove. The unit is then set into operation by squeezing valve control 38 and applying pressure on hand hold 16 to compress the weight counterbalance spring 28 to engage the finishing wheel 44 with the bottom surface of the groove.

The present invention is therefore capable of providing a groove refinishing tool which is portable, hand held, and capable of refinishing the bottom surface of a groove in an easy and efficient manner. The device allows for easy adjustment for various curvature o-rings or straight grooves. Also, the finishing wheel can be easily and quickly replaced without changing the position of the arbor and consequently, the position of the finishing wheel in the groove so as to insure a uniform refinishing operation. Adjustments are also provided for preventing undesired refinishing by using a weight counterbalance spring which automatically removes the finishing wheel from the finishing surface when pressure is not being applied. Additionally, a depth adjustment screw prevents applying too much pressure to the groove surface by the finishing wheel. A window on the device also allows for visual observation of the refinishing operation.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, adjustable guide pins could be used in place of guide pins 68 and 70 to also allow for different radius curvature o-ring grooves. Moreover, the device of the present invention should not be limited to o-ring grooves specifically, but refinishing of any slot groove and can be used to refinish groove sides both perpendicular and angular. Also, an actual milling wheel could be used in place of finishing wheel 44 to perform milling operations using the device of the preferred embodiment of the invention. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A device for refinishing a groove in a flat surface comprising:

a main body having a main body finishing wheel slot formed therein;

a rigid planar shoe having a shoe finishing wheel slot formed therein, said shoe pivotally mounted at one end to said main body;

a finishing wheel motor attached to said main body;

a finishing wheel attached by a collet and arbor to said finishing wheel motor such that said finishing wheel protrudes through said main body finishing wheel slot and said shoe finishing wheel slot for refinishing said groove;

slot guide means attached to said shoe and extending downwardly from a lower surface thereof, said slot guide means being offset from said shoe finishing slot and extending into said groove for guiding said device on said groove as said device is refinishing said groove.

2. The device of claim 1 wherein said slot guide means are offset from said shoe finishing wheel slot to compensate for curvature of circular grooves.

3. The device of claim 1 further comprising means for adjusting the position of said finishing wheel relative to said slot guide means to compensate for curvature of o-ring grooves.

4. The device of claim 3 wherein said collet and arbor comprise means for detaching said finishing wheel from said finishing wheel motor to replace said finishing wheel without changing the position of said means for adjusting.

5. The device of claim 1 further comprising adjustable spring means disposed between said main body and said shoe for separating said main body and said shoe by a predetermined amount to prevent refinishing to o-ring grooves until pressure is applied to said main body.

6. The device of claim 1 further comprising depth stop adjustment means for maintaining an adjustable minimum separation between said shoe and said main body to control the amount said finishing wheel protrudes through said shoe finishing wheel slot.

7. The device of claim 1 further comprising a main body finishing wheel slot window disposed over said main body finishing wheel slot to provide visual observation of operation of said device for refinishing grooves.

* * * * *